United States Patent [19]

Ishikawa et al.

[11] Patent Number: 4,799,467

[45] Date of Patent: Jan. 24, 1989

[54] THROTTLE VALVE CONTROL SYSTEM FOR AN INTERNAL COMBUSTION ENGINE

[75] Inventors: Yoshikazu Ishikawa; Kouji Yamaguchi, both of Wako, Japan

[73] Assignee: Honda Giken Kogyo Kabushiki Kaisha, Tokyo, Japan

[21] Appl. No.: 73,616

[22] Filed: Jul. 15, 1987

[30] Foreign Application Priority Data

| | | | |
|---|---|---|---|
| Jul. 16, 1986 | [JP] | Japan | 61-168843 |
| Jul. 16, 1986 | [JP] | Japan | 61-168845 |
| Jul. 16, 1986 | [JP] | Japan | 61-168847 |
| Jul. 16, 1986 | [JP] | Japan | 61-168848 |

[51] Int. Cl.[4] ..... F02D 9/02; F02D 41/04

[52] U.S. Cl. ..... 123/399

[58] Field of Search ..... 123/339, 361, 399

[56] References Cited

U.S. PATENT DOCUMENTS

| | | | |
|---|---|---|---|
| 2,476,652 | 7/1949 | Black | 123/361 X |
| 4,237,833 | 12/1980 | Des Lauriers | 123/339 |

FOREIGN PATENT DOCUMENTS

| | | | |
|---|---|---|---|
| 112150 | 6/1984 | European Pat. Off. | 123/399 |
| 133446 | 8/1983 | Japan | 123/399 |

OTHER PUBLICATIONS

SAE Paper Number 780346, "Engine Air Control–Basis of a Vehicular Systems Control Hierarchy" by D. L.Stivender, copyright 1978.

SAE Paper Number 700885, "Fishhooks and Carburetor Calibration" by P. H. Schweitzer, Nov. 4–6, 1970.

SAE Paper Number 710845, "The Automotive Engine–Today and Tomorrow", by M. M. Roensch, Oct. 26–29, 1971.

*Primary Examiner*—Tony M. Argenbright

*Attorney, Agent, or Firm*—Pollock, Vande Sande and Priddy

[57] ABSTRACT

A throttle valve control system for an internal combustion engine sets a target manifold pressure for attaining a minimum fuel consumption rate in response to a detected engine rotational speed, and drives the throttle valve to a control opening determined so as to reduce the difference between the detected actual manifold pressure and the target manifold pressure. According to another feature, the system detects the operation position of the accelerator pedal and the throttle valve is driven to a control opening which is determined in accordance with the operation position of the accelerator pedal or the rate of change in the operation position of the accelerator pedal when the operation position or the rate of change in the operation position exceeds a predetermined value, respectively.

7 Claims, 13 Drawing Sheets

| FIG. 11B | FIG. 11A |
|---|---|

THROTTLE VALVE CONTROL SYSTEM FOR AN INTERNAL COMBUSTION ENGINE

BACKGROUND OF THE INVENTION

1. Field of the invention

The present invention relates to a throttle valve control system for controlling the opening of the throttle valve of an internal combustion engine.

2. Description of Background Information

Various measures have been proposed for improving fuel economy of an internal combustion engine. The lean burn system characterized by the supply of a lean air-fuel mixture, the generation of swirling action in the combustion chamber for enhancing sufficient mixture flow in the combustion chamber, or the improvement of the shape of the combustion chamber, are examples of such measures. However, in those systems, there has been a problem that the structure of the system generally becomes complicated, so that an increase of the cost is not avoided. One method for solving the above problem is to provide a system for controlling the opening of the throttle valve of the engine. For example, Japanese Patent Application Laid Open No. P60-192843 discloses a control of the throttle valve opening in which the throttle valve opening is determined simply in accordance with the operation position of the accelerator pedal and the engine rotational speed. Therefore, the improvement of the fuel economy was not gained by such a throttle valve opening control.

If the throttle valve opening is controlled for the purpose of fuel economy only, the throttle valve may not be fully opened even if the accelerator pedal is depressed sufficiently. In such an event, it is not possible to secure a good acceleration of the vehicle by using the maximum engine power. Therefore, it is desirable to devise a suitable measure for preventing such a problem.

Furthermore, if the vehicle is equipped with a system for controlling the engine rotational speed in accordance with the operating position of the accelerator pedal such as the CVT (continuously variable transmission), the engine rotational speed does not rise rapidly due to a delay of response of the system against the control even if the throttle valve is depressed rapidly for accelerating the vehicle. In other words, the throttle valve opening can not be increased rapidly, thus causing it impossible to secure the good acceleration of the vehicle. Therefore, it is desirable to devise a suitable measure for preventing such a problem.

SUMMARY OF THE INVENTION

An object of the present invention is therefore to provide a throttle valve control system for an internal combustion engine which has a simple structure and which can be made at relatively low cost, while enabling sufficient improvement of the fuel economy.

Another object of the present invention is to provide a throttle valve control system for an internal combustion engine by which the fuel economy is improved while the acceleration characteristic of the engine is sufficiently maintained.

A further object of the present invention is to provide a throttle valve control system for an internal combustion engine by which the fuel economy is improved while the acceleration of the engine under a condition in which the accelerator pedal is depressed rapidly is maintained.

According to the present invention, the throttle valve control system is operative to set a target pressure in the intake pipe (referred to as intake manifold pressure hereinafter) at which an optimum fuel economy is attained in accordance with a detected engine speed, and the opening angle of the throttle valve is controlled as to reduce a difference between the target intake manifold pressure and a detected actual intake manifold pressure.

According to another aspect of the present invention, the throttle valve control system is operative to set the target intake manifold pressure of the engine at which an optimum fuel economy is accomplished in accordance with the detected engine speed, to set a correction amount in accordance with a difference between the target intake manifold pressure and the detected actual intake manifold pressure and a detected engine rotational speed, and to drive the throttle valve as much as the thus determined correction amount of the throttle valve opening.

According to a further aspect of the present invention, the throttle valve control system is operative to stop the drive of the throttle for attaining the target intake manifold pressure and to drive the throttle valve only in accordance with a detected operation position of the throttle valve if the actual throttle valve opening is smaller than a target throttle valve opening under a condition that the detected operation position of the accelerator pedal is greater than a predetermined position.

According to a further aspect of the present invention, the throttle valve control system is operative to drive the throttle valve to an opening angle corresponding to a detected rate of change in the operation position of the throttle valve when the rate of change in the detected operation position of the accelerator pedal is greater than a predetermined value, and subsequently to control gradually the throttle valve to a control throttle valve opening so as to reduce the difference between the actual manifold pressure and the target manifold pressure.

According to a still further aspect of the present invention, the throttle valve control system is operative to set a target engine rotational speed in accordance with the operation position of the accelerator pedal, to set the target intake manifold pressure at which the minimum fuel consumption rate is attained correspondingly to the detected actual engine rotational speed, to correct the target manifold pressure in accordance with the difference between a target engine rotational speed and the actual engine rotational speed, and to drive the throttle valve to decrease the difference between the detected intake manifold pressure and the target intake manifold pressure after being corrected.

DETAILED DESCRIPTION OF PREFERRED EMBODIMENTS

The preferred embodiment of the present invention will be described with reference to the accompanying drawings.

Figure 1:
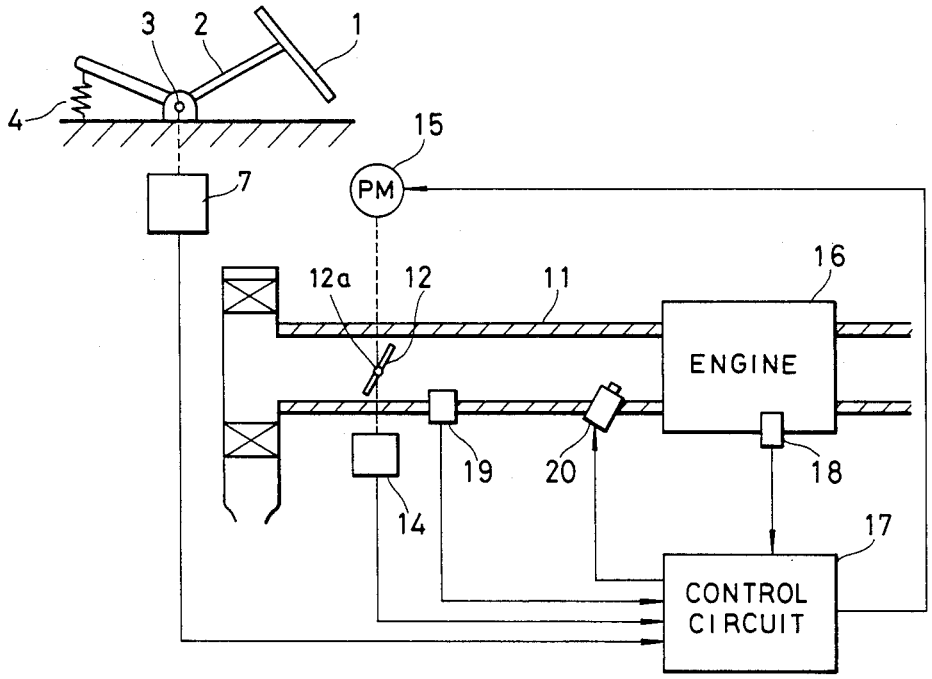
FIG. 1 is a schematic diagram of the construction of embodiments of the present invention.

In the throttle valve control system shown in FIG. 1 as the preferred embodiment of the present invention, an accelerator pedal 1 is connected at an end of a bracket 2 having a generally dogleg shape, which is supported on a shaft 3 so that a swing motion of the accelerator pedal 1 with respect to the floor of the vehicle is permitted. At the other end of the bracket 2, there is provided a return spring 4 for urging the accelerator pedal 1 toward an idling position. An accelerator pedal operating position sensor 7 made up of a potentiometer is connected to the shaft 3, and produces an output voltage corresponding to the accelerator pedal angle, i.e. the rotation angle of the pedal 1 around the shaft 3 from the idle position.

On the other hand, a throttle valve 12 is provided in an intake pipe 11 of the engine and a shaft 12*a* of the throttle valve 12 is provided with a throttle valve opening sensor 14 which is made up of a potentiomater accelerator pedal operating position sensor 7. The throttle valve opening sensor 14 generates an output voltage corresponding to an opening angle of the throttle valve 12. In addition, a rotation shaft of a pulse motor 15 is connected to the shaft 12*a* of the throttle valve 12.

The accelerator pedal operation position sensor 7, the throttle valve opening sensor 14, and the pulse motor 15 are connected circuit 17. To the control circuit 17 are also connected a crank angle sensor 18 which generates a pulse signal at a predetermined angular position of a crankshaft of the engine (not shown) with the rotation of the crankshaft, an absolute pressure sensor 19 for generating an output signal which represents an absolute intake manifold pressure, and an injector 20 for injecting the fuel into the engine.

Figure 2:
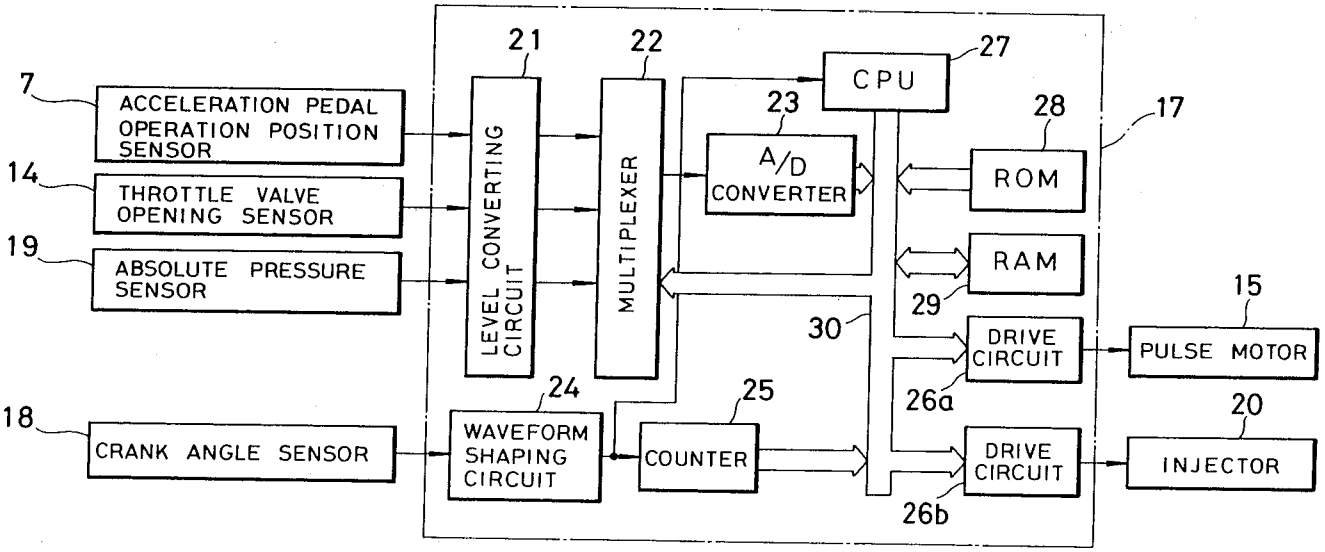
FIG. 2 is a block diagram showing a concrete construction of the control circuit in the system shown in FIG. 1.

The control circuit 17 is, as shown in FIG. 2, made up of a level converting circuit 21 for the level conversion of respective output signals of the accelerator pedal operating position sensor 7, the throttle valve opening sensor 14, and the absolute pressure sensor 19, a multiplexer 22 for selectively transmitting one of the voltage signals supplied through the level converting circuit 21, an A/D converter 23 for performing an analog to digital conversion of an output signal of the multiplexer 22, a waveform shaping circuit 24 for the waveform shaping of the output signal of the crankangle sensor 18, a counter for measuring the interval of generation of TDC signals which are produced as the pulse signals generated by the waveform shaping circuit 24, by counting clock pulses supplied from a clock pulse generating circuit (not shown), a drive circuit 26*a* for driving the pulse motor 15, a drive circuit 26*b* for driving the injector 20, a CPU (central processing unit) 27 for performing digital operations in accordance with programs, a ROM 28 in which programs and data are stored previously, and a RAM 29. The multiplexer 22, the A/D converter 23, the counter 25, the drive circuits 26*a* and 26*b*, the CPU 27, the ROM 28, and the RAM 29 are mutually connected by means of a bus 30. Furthermore, a clock pulse signal is supplied to the CPU 27 from a clock pulse signal generating circuit which is not illustrated. The CPU 27 operates as a target value setting means, and the CPU 27 and the drive circuit 26*a* operate as throttle valve driving means.

With this structure, information of the accelerator pedal angle $\theta_{ACC}$, the throttle valve opening angle $\theta$th, and the absolute intake manifold pressure $P_{BA}$ selectively from the A/D converter 23 as well as information of the engine rotational speed Ne from the counter 25, is supplied to the CPU 27 through the bus 30. The CPU 27 reads the above information according to the operation program stored in the ROM 28 and in synchronism with the clock pulse.

By the processing operation which will be explained later, the CPU 27 generates a pulse motor valve open drive command and a pulse motor valve close drive command for driving the pulse motor 15, and a pulse motor drive stop command for stopping the drive of the pulse motor 15, and supplies them selectively to the drive circuit 26*a*.

Figure 3:
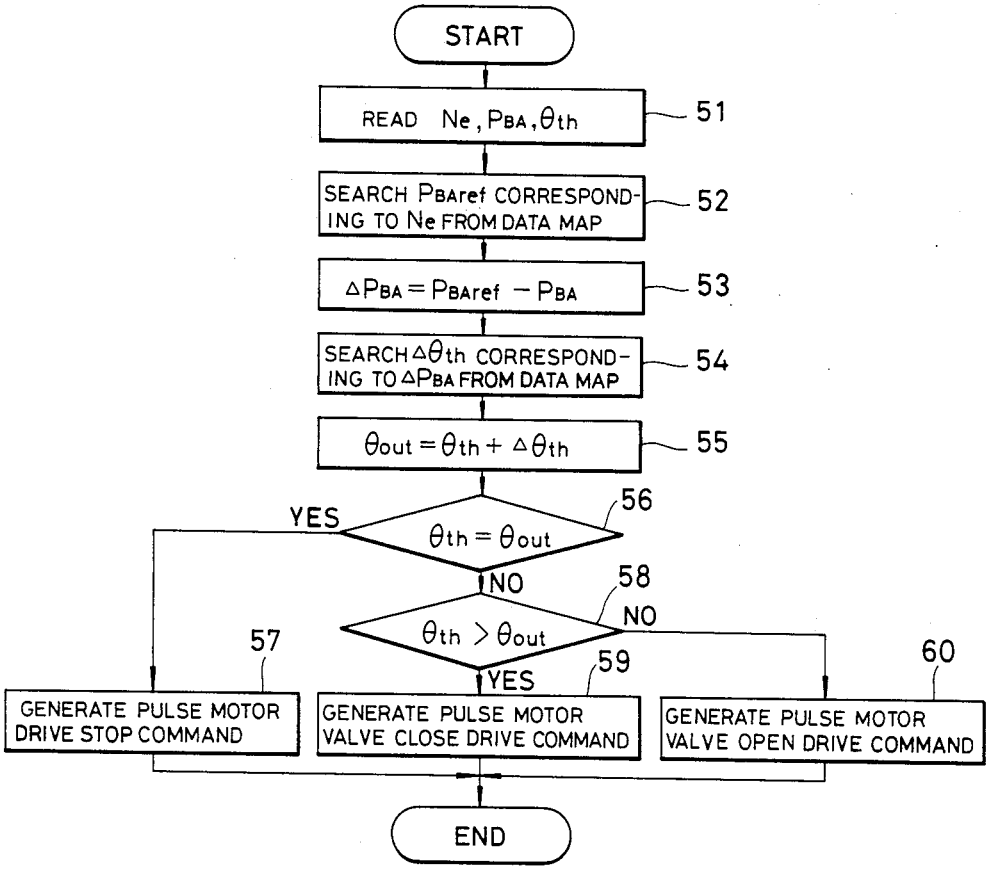
FIG. 3 is a flowchart showing the operation of the CPU 27 in a first embodiment of the present invention.

The operation of the first embodiment of a throttle valve control system having the above construction according to the present invention will be explained with reference to the operation flowchart of the CPU 27 shown in FIG. 3.

Figure 4:
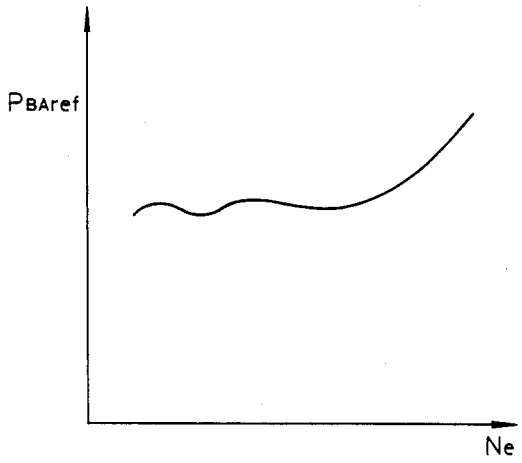
FIG. 4 is a diagram showing the characteristic of the $P_{BAref}$ data map which is previously stored in the ROM 28.

At predetermined intervals, the CPU 27 reads the engine rotational speed Ne, the absolute intake manifold pressure $P_{BA}$ and the throttle valve opening $\theta$th at a step 51. A target absolute intake manifold pressure $P_{BAref}$ corresponding to the read value of the engine rotational speed Ne is set at a step 52. In the ROM 28, various values of the target absolute intake manifold pressure $P_{BAref}$ at which a minimum fuel consumption rate is attained, are previously stored correspondingly to the engine rotational speed value in the form of a $P_{BAref}$ data map, as shown by the characteristic curve of FIG. 4. Therefore, the CPU 27 searches a value of the target absolute intake manifold pressure $P_{BAref}$ corresponding to the read value of the engine rotational speed Ne from the $P_{BAref}$ data map.

Then, the CPU 27 calculates a difference $\Delta P_{BA}$ between the target intake manifold pressure $P_{BAref}$ and the read value of the absolute intake manifold pressure $P_{BA}$ at a step 53. Subsequently, at a step 54, the CPU 27 4 searches a correction amount $\Delta\theta$th of the opening of the throttle valve 12 corresponding to the difference $\Delta P_{BA}$ from a $\Delta\theta$th data map which is previously stored in the ROM 28 as shown by the characteristic curve of FIG. 5. Then the read value of the throttle valve opening $\theta$th and the correction amount of the opening $\Delta\theta$th are added together to generate a control throttle valve opening $\theta$out at a step 55. Then whether or not the read value of the throttle valve opening $\theta$th is equal to the control throttle valve opening $\theta$out is detected at a step 56. If $\theta th = \theta out$, the pulse motor drive stop command is generated and supplied to the drive circuit 26a at a step 57. If, on the other hand, $\theta th \neq \theta out$, whether or not the throttle valve opening $\theta$th is greater than the control throttle valve opening $\theta$out is detected at a step 58. If $\theta th > \theta out$, the pulse motor valve close drive command is generated and supplied to the drive circuit 26a at a step 59 so as to move the throttle valve in the closing direction. If $\theta th > \theta out$ is not satisfied, i.e., if $\theta th < \theta out$, the pulse motor valve open drive command is generated and supplied to the drive circuit 26a at a step 60 so as to drive the throttle valve 12 in the opening direction. The drive circuit 26a drives the pulse motor 15 in the forward direction in response to the pulse motor open drive command, to move the throttle valve 12 in the opening direction. In response to the pulse motor valve close drive command, the drive circuit 26a drives the pulse motor 15 in the reverse direction, to move the throttle valve 12 in the closing direction. Furthermore, in response to the pulse motor drive stop command, the drive circuit 26a stops the drive of the pulse motor 15, to maintain the opening of the throttle valve 12 at that moment. By these operations, the opening angle $\theta$th of the throttle valve is controlled so that it follows the control throttle valve opening $\theta$out.

Figure 6:
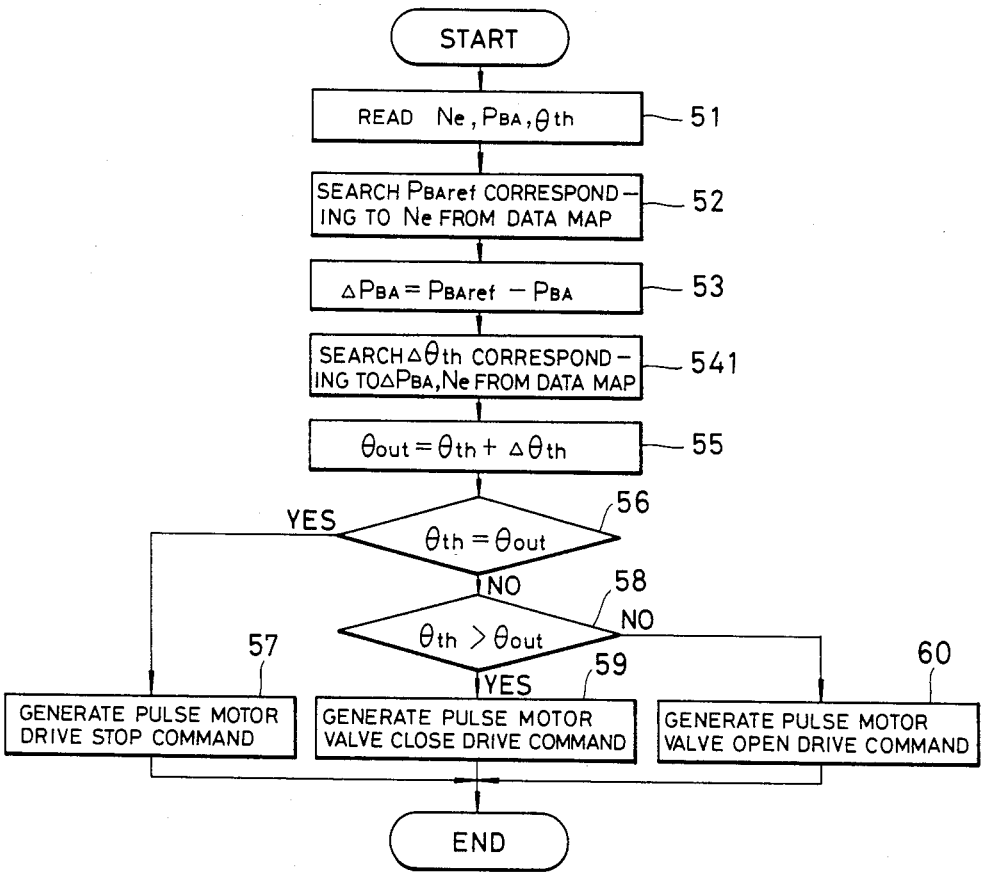
FIG. 6 is a flowchart showing the operation of the CPU 27 in a second embodiment of the present invention.
Figure 7:
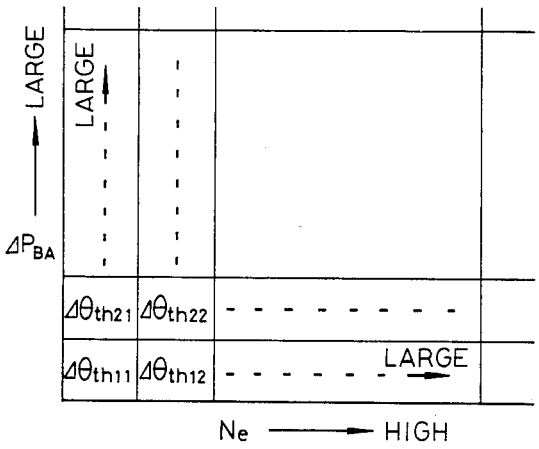
FIG. 7 is a diagram showing the $\Delta\theta$th data map stored in the ROM 28 in the second embodiment of the present invention.

FIG. 6 is a flowchart showing the second embodiment of the throttle control system according to the present invention in which the CPU 27 is in the same system structure as illustrated in FIG. 2. In the operation shown in this figure, the CPU 27 performs the operations 51 through 53 as in the case of the operation shown in FIG. 3. When the difference $\Delta P_{BA}$ is calculated at the step 53, the CPU 27 searches, at a step 541, the correction opening value $\Delta\theta$th of the throttle valve 12 (opening correction value) corresponding to the $\Delta$ read value of the engine rotational speed Ne from the $\Delta\theta$th data map which is previously stored in the ROM 28 in the manner as shown in FIG. 7. Then the read value of the throttle valve opening $\theta$th is added to the correction value of the opening $\Delta\theta$th to produce the control throttle valve opening $\theta$out at the step 55. In the $\Delta\theta$th data map, data are recorded in such a manner that the correction opening value $\Delta\theta$th increases as the difference $\Delta P_{BA}$ increases, and it increases as the engines speed Ne increases.

Figure 8:
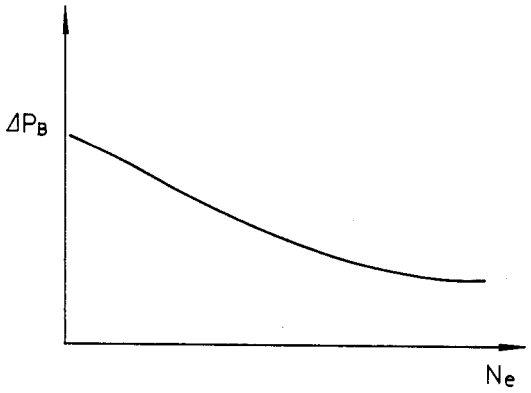
FIG. 8 is a diagram showing the relation between the engine rotational speed Ne and the unit change $\Delta P_B$ of the absolute intake manifold pressure under a condition that the change in the throttle valve opening is constant.

In the thus constructed throttle valve control system according to the present invention, a unit change $\Delta P_B$ of the intake manifold pressure per unit change in the opening of the throttle valve becomes small as the engine rotational speed Ne increases, as typically shown in FIG. 8. Therefore, by the determination in accordance with the difference $\Delta P_{BA}$ between the actual intake manifold pressure and the set value of the target intake manifold pressure, and the engine rotational speed Ne, the opening correction value $\Delta\theta$th can always be a proper value i.e., neither too much nor too little, throughout the engine speed range (from low speed to high speed). By using this opening correction opening value, the throttle valve opening can be adjusted to the proper opening value very rapidly.

As will be appreciated from the foregoing, the first embodiment of the throttle valve control system of the present invention is characterized by setting a target intake manifold pressure at which a minimum fuel consumption rate is attained correspondingly to the engine rotational speed, and the throttle valve is driven to decrease the difference between the actual intake manifold pressure and the set value of the target intake manifold pressure. Thus, the fuel consumption characteristic is improved by means of a relatively simple structure, and at low cost. Furthermore, the delay of the control operation is also prevented, thus improving the response characteristic of the control system.

In the second embodiment of the present invention, the target intake manifold pressure at which the minimum fuel consumption rate is attained is set correspondingly to the engine rotational speed, an opening value of the throttle valve is set in accordance with the difference between the actual intake manifold pressure and the set value of the target intake manifold pressure, and the rotational speed of the engine, and the throttle valve is driven so that the opening of the throttle valve becomes equal to the set value of the throttle valve opening. Thus, the improvement of the fuel economy as well as the improvement of the response characteristic of the system in a high rotational speed region of the engine is accomplished.

Referring the flowchart of FIG. 9, the third embodiment of the present invention will be explained.

In the third embodiment, the CPU 27 operates as first and second setting means, and the CPU 27 and the drive circuit 26a operate as the drive means.

Figure 5:
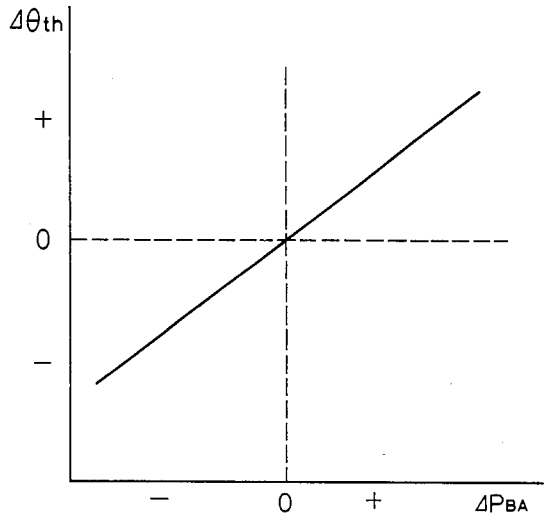
FIG. 5 is a diagram showing the characteristic of the $\Delta\theta$th data map which is previously stored in the ROM 28.
Figure 9:
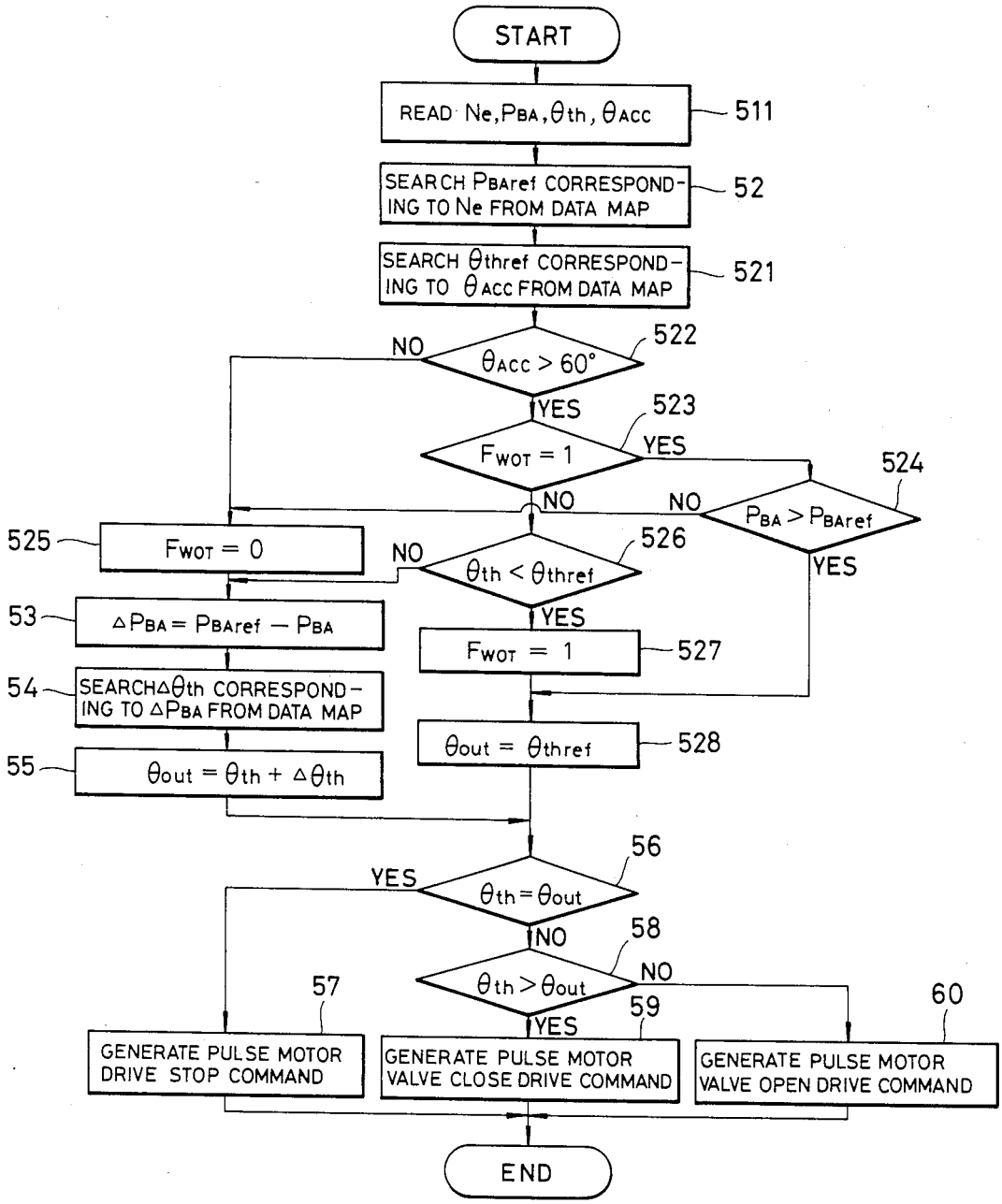
FIG. 9 is a flowchart showing the operation of the CPU 27 in a third embodiment of the present invention.

In the flowchart of FIG. 9, the CPU 27 reads, at predetermined intervals, the engine rotational speed Ne, the absolute intake manifold pressure $P_{BA}$, and the throttle valve opening $\theta$th, and further an accelerator pedal angle $\theta_{ACC}$ at a step 511. Then, the CPU 27 searches, from the $P_{BAref}$ data map shown in FIG. 4, the target absolute intake manifold pressure $P_{BAref}$ at the step 52. In the ROM 28, various values of the target throttle valve opening $\theta_{thref}$ corresponding to the accelerator pedal angle $\theta_{ACC}$ are previously stored in the form of a $\theta$thref data map having the characteristic shown in FIG. 10 and the CPU 27 searches a target throttle valve opening $\theta$thref corresponding to the read value of the accelerator pedal angle $\theta_{ACC}$ at a step 521. Then whether or not the read value of the accelerator pedal angle $\theta_{ACC}$ is greater than 60° is detected at a step 522. If $\theta_{ACC} \leqq 60°$, it means that the accelerator pedal 1 is not in a fully open region (fully depressed region), and a flag $F_{WOT}$ is made equal to 0 at a step 525 in order to perform a control using the target absolute intake manifold pressure. Subsequently, as in the first embodiment of the invention, the CPU 27 calculates the difference $\Delta P_{BA}$ between the target absolute intake manifold pressure $P_{BAref}$ and the read value of the absolute pressure PBA in the intake manifold at the step 53. Then the correction amount of the opening of the throttle valve 12 is searched at the step 54 from the $\Delta\theta$th data map whose characteristic is shown in FIG. 5. The control throttle valve opening $\theta$out is in turn calculated, at the step 55, by adding the correction amount $\Delta\theta$th of the opening of the throttle valve 12 to the read value of the opening $\theta$th. On the other hand, if $\theta_{ACC}>60°$, it means that the position of the acceleration pedal is in the fully open region, and whether or not the flag FWOT is equal to 1 is detected at a step 523. If FWOT=0, it means that the control operation using the target absolute value in the intake manifold has been performed during a previous execution of the main routine, and whether or not the read value of the actual throttle valve opening $\theta$th is smaller than the target throttle valve opening $\theta$thref is determined at a step 526. If $\theta th \geqq \theta thref$, the step 53 is executed in the control operation using the target absolute intake manifold pressure. If $\theta th<\theta thref$, the flag FWOT is made equal to 1 at a step 527, and the control throttle valve opening $\theta$out is made equal to the target throttle valve opening $\theta$thref at a step 528 in order to execute a control for fully opening the throttle valve.

If FWOT=1 at the step 523, it means that the control for fully opening the throttle valve has been executed during the previous execution of the main routine, and whether or not the absolute intake manifold pressure $P_{BA}$ is greater than the target absolute intake manifold pressure $P_{BAref}$ is detected at a step 524. If $P_{BA}>P_{BAref}$, it means that the engine is operating under a high load condition, and the control throttle valve opening $\theta$out is made equal to the target throttle valve opening $\theta$thref by execution of the operation of the step 528. If, on the other hand, $P_{BA}\leqq P_{BAref}$, it means that the engine is not operating under the high load condition, and the flag FWOT is made equal to 0 and the control throttle valve opening $\theta$out is calculated by using the difference $\Delta P_{BA}$ through the operations of the steps 525, 53, 54, and 55. This is because the control for fully opening the throttle valve should be stopped and it is suitable to return to the control operation using the target absolute manifold pressure under this condition.

After setting the control throttle valve opening $\theta$out at the step 55 or the step 528, whether or not the read value of the throttle valve opening $\theta$th is equal to the control throttle valve opening 8 out is detected at the step 56. Subsequently, the operations of the steps 57 through 60 are executed in the same manner as in the previous embodiments.

Figure 10:
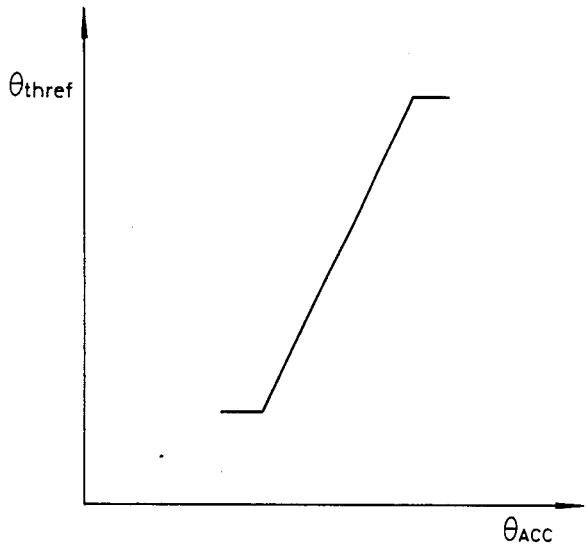
FIG. 10 is a diagram showing the characteristic of a $\theta$thref data map which is previously stored in the ROM 28 in the third embodiment of the present invention.

In the thus explained third embodiment of the present invention, the engine output power can be increased smoothly from a low engine rotational speed value because the control throttle valve opening $\theta$out is determined in accordance with the characteristic shown in FIG. 10, in the fully open region of the accelerator pedal.

Moreover, as explained, in the third embodiment of the throttle valve control system, the drive of the throttle valve for attaining the target intake manifold pressure is stopped and the throttle valve is driven only in accordance with the operation position of the accelerator pedal if the actual throttle valve opening is smaller than the target throttle valve opening under the condition that the accelerator pedal is in the fully open region in which the operation position of the accelerator pedal is further than a predetermined position. Therefore, the acceleration characteristic of the engine is if the operation position of the accelerator pedal is in the fully open region, and the fuel economy is improved when the operation position of the accelerator pedal is in regions other than the fully open region.

In the above explained embodiments of the present invention, the opening correction value $\Delta\theta$th is determined by using the $\Delta\theta$th data map. However, this is not limitative and the opening correction value $\Delta\theta$th can be derived by using a calculation formula such as $\Delta\theta th = k_1 \cdot \Delta P_{BA}$, or $\Delta\theta th = k_2 \cdot Ne \cdot \Delta P_{BA}$ ($k_1$, $k_2$ being a constant respectively).

Figure 11A:
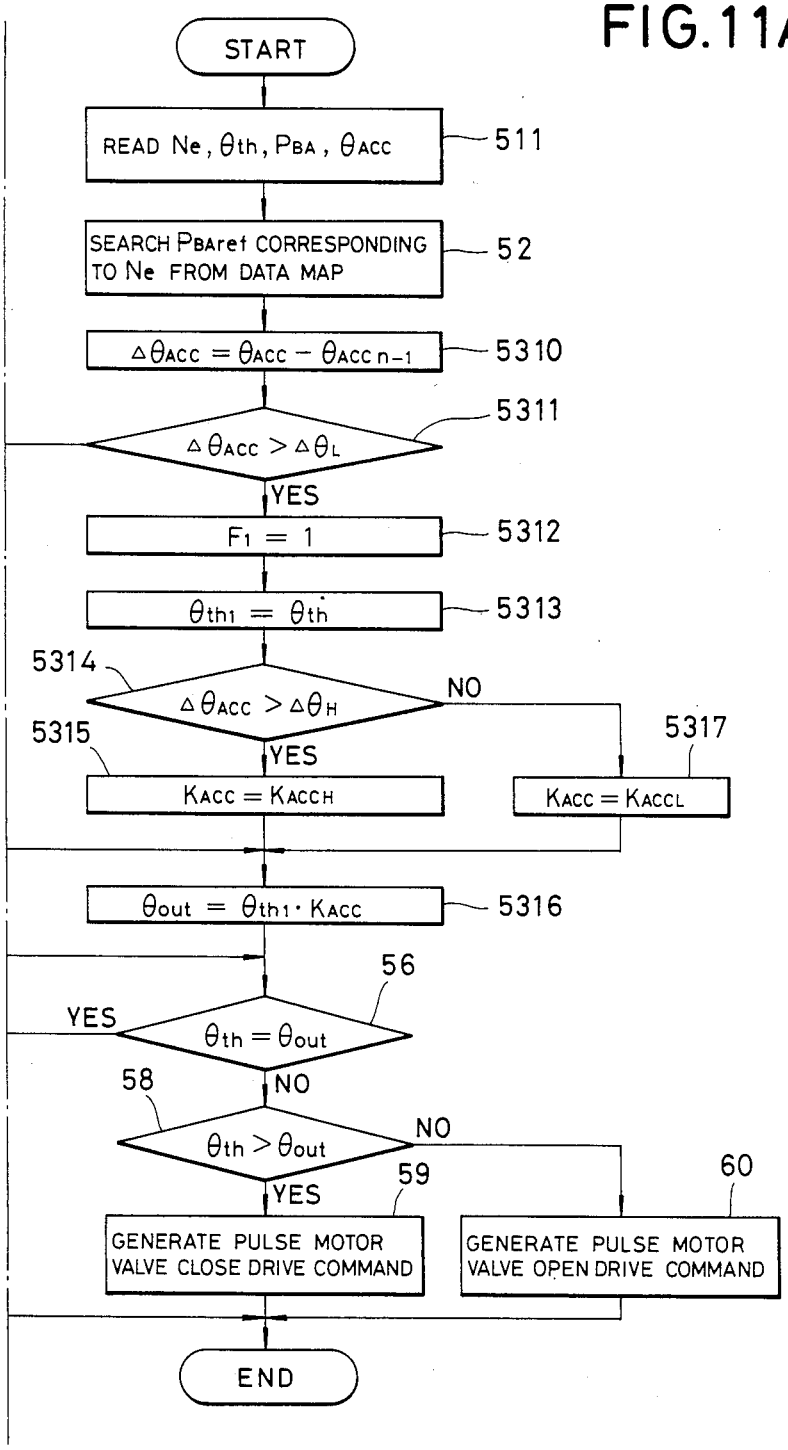
FIGS. 11A and 11B are, when combined together, a flowchart showing the operation of the CPU 27 in a fourth embodiment of the present invention.
Figures 11, 11B:
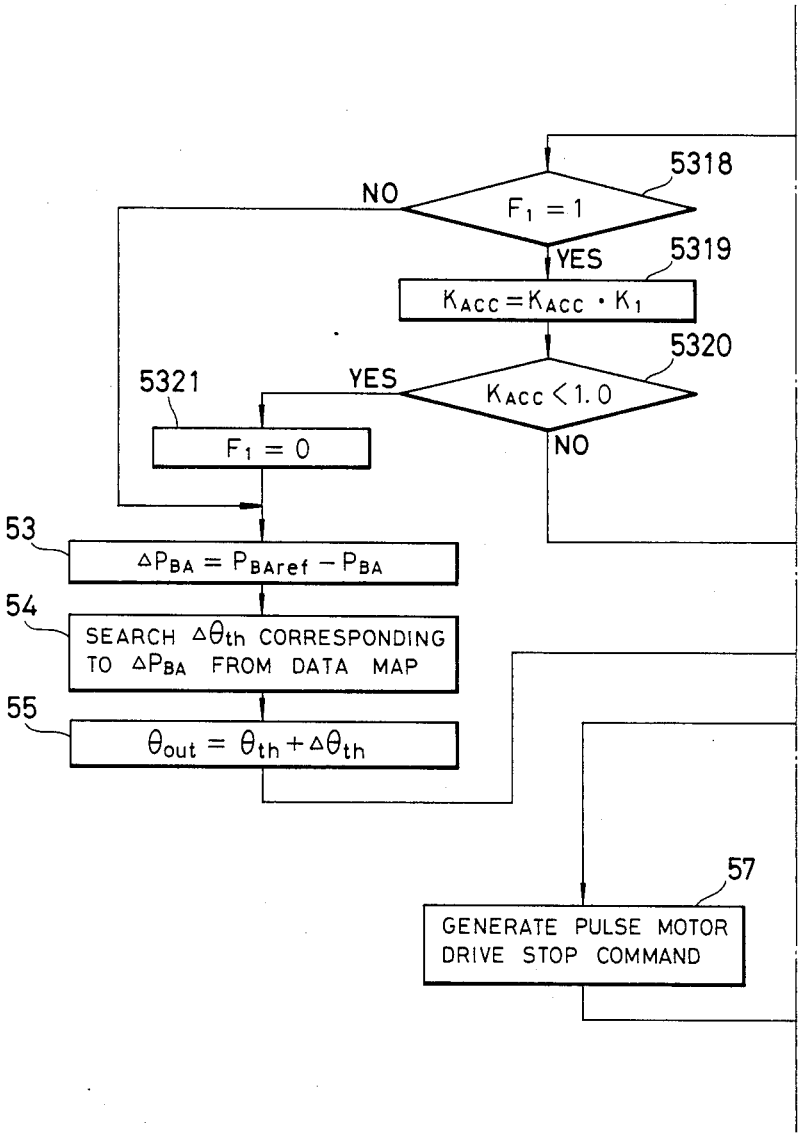
FIG. 11 is a diagram showing the juxtaposition of FIGS. 11A and 11B.

Referring to the flowchart of FIGS. 11A and 11B, the operation of the fourth embodiment of the throttle valve control system according to the present invention will be explained.

Figure 12:
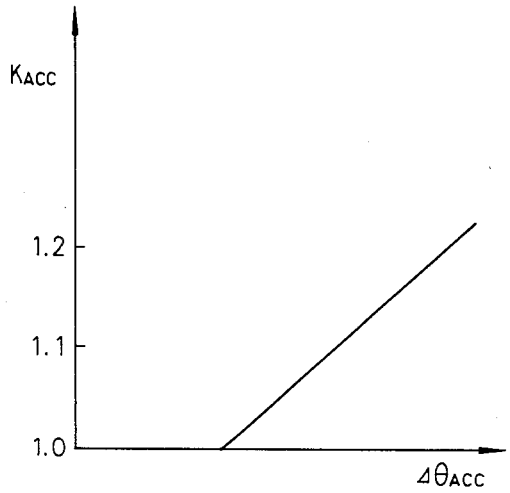
FIG. 12 is the characteristic of a $K_{ACC}$ data map previously stored in the ROM 28 in the fourth embodiment of the present invention.

As in the previous embodiments, the CPU 27 reads the engine rotational speed Ne, the absolute pressure manifold pressure $P_{BA}$, the throttle valve opening $\theta$th and the acceleration pedal angle $\theta_{ACC}$ at predetermined intervals at the step 511. In accordance with the read value of the engine rotational speed Ne, the CPU 27 searches, at the step 52, the target absolute manifold pressure corresponding to the read value of the engine rotational speed Ne from the $P_{BAref}$ data map having the characteristic shown in FIG. 4. Then, the CPU 27 calculates, at a step 5310, an amount of change $\Delta\theta_{ACC}$ between the accelerator pedal angle $\theta_{ACC}$ read this time and the accelerator pedal angle $\theta_{ACCn-1}$ read at a previous time. Then whether or not the amount of change $\Delta\theta_{ACC}$ is greater than a predetermined value $\Delta\theta_L$ is detected at a step 5311. If $\Delta\theta_{ACC}>\Delta\theta_L$, it means that the amount of change $\Delta\theta_{ACC}$ is large, i.e., the accelerator pedal is depressed rapidly, and a flag $F_1$ is made equal to 1 at a step 5312, and the read value of the throttle valve opening $\theta$th is set as a throttle valve opening $\theta th_1$ under a rapid operation of the accelerator pedal, at a step 5313. Then, whether or not the amount of change $\Delta\theta_{ACC}$ is greater than a predetermined value $\Delta\theta_H$ ($\Delta\theta_H>\Delta\theta_L$) is detected at a step 5314. If $\Delta\theta_{ACC}>\Delta\theta_H$, an acceleration speed coefficient $K_{ACC}$ is set to be a predetermined value $K_{ACCH}$ at a step 5315. This acceleration speed coefficient $K_{ACC}$ is multiplied to the throttle valve opening $\theta th_1$ under the rapid operation of the accelerator pedal, and the value obtained by the calculation is set as the control throttle valve opening $\theta$out at a step 5316. If $\Delta\theta_{ACC}\leqq\Delta\theta_H$, the acceleration speed coefficient is set to be a predetermined value $K_{ACCL}$ ($K_{ACCH}>K_{ACCL}>1$) at a step 5317. Subsequently, by the execution of the operation of the step 5316, the acceleration speed coefficient $K_{ACC}$ is multiplied to the throttle valve opening $\theta th_1$ under the rapid operation of accelerator pedal, and the value obtained by the calculation is set as the control throttle valve opening $\theta$out. Furthermore, the operation of the system may be modified such that, instead of the operations of the steps 5314, 5315, and 5317, the relation between the amount of the change $\Delta\theta_{ACC}$ in the accelerator pedal position and the acceleration speed coefficient $K_{ACC}$ which is shown in FIG. 12 is previously stored in the ROM 28 in the form of a data map, and the acceleration speed coefficient $K_{ACC}$ is searched from the data map.

On the other hand, if $\Delta\theta_{ACC}\leqq\Delta\theta_L$ at the step 5311, whether or not the flag F1 is equal to 1 is detected at a step 5318. If $F_1=0$, it means that the accelerator pedal is not depressed rapidly, and the difference $\Delta P_{BA}$ between the target absolute manifold pressure $P_{BAref}$ and the read value of the absolute manifold pressure PBA is calculated at the step 53. Subsequently, the operations of the steps 54 and 55 are performed in the same manner as the previous embodiments. If $F_1=1$ at the step 5318, it means that the operation of the engine is immediately after the rapid depression of the accelerator pedal. In this state, a coefficient $K_1$ ($K_1<1$) is multiplied to the acceleration speed coefficient $K_{ACC}$, and the calculated value is set as the new acceleration speed coefficient $K_{ACC}$, at a step 5319. Then, whether or not the acceleration speed coefficient $K_{ACC}$ is smaller than a value of 1.0 is detected at a step 5320. If $K_{ACC}>1.0$, the control throttle valve opening $\theta$out is calculated by the execution of the operation of the step 5316. If $K_{ACC}<1.0$, the flag $F_1$ is made equal to 0 at a step 5321, and the control throttle valve opening $\theta$out is set through the operations of the steps 53 through 55.

After the setting of the control throttle valve opening $\theta$out at the step 5316 or the step 55, the operations of the steps 56 through 60 are executed in the same manner as previous embodiments.

Figure 13:
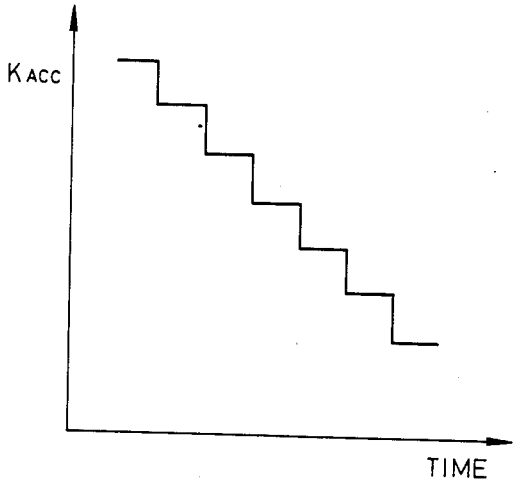
FIG. 13 is a diagram showing the change in the coefficient, $K_{ACC}$ immediately after a rapid depression of the accelerator pedal.

In this fourth embodiment of the throttle valve control system according to the present invention, the acceleration speed coefficient $K_{ACC}$ is determined in accordance with the amount of the change $\Delta\theta_{ACC}$ in the accelerator pedal position if the amount $\Delta\theta_{ACC}$ becomes greater than $\Delta\theta_L$ by the rapid depression of the acceleration pedal 1. Subsequently, by multiplying the coefficient $K_1$ thereto, the accelerator speed coefficient $K_{ACC}$ decreases as time elapses, in such a manner as shown in FIG. 13. Therefore, the throttle valve opening $\theta$th increases rapidly by the rapid depression of the accelerator pedal to the value $\theta th_1 \cdot K_{ACCH}$ or the value $\theta th_1 \cdot K_{ACCL}$, and subsequently gradually decreases to reach the control throttle valve opening $\theta$out.

As explained above, in the fourth embodiment of the throttle valve control system for a vehicle mounted internal combustion engine according to the present invention, the throttle valve is driven to an opening corresponding to the rate of change in the operation position of the accelerator pedal when the rate of change is greater than the predetermined value, and subsequently the throttle valve is gradually driven to a control throttle valve opening for decreasing the difference between the actual intake manifold pressure and the target intake manifold pressure. Therefore, when the accelerator pedal is depressed rapidly, the opening of the throttle valve increases rapidly, to raise the rotational speed of the engine at once. Thus, a satisfactory acceleration characteristic at the time of the rapid depression of the accelerator pedal is secured.

Referring now to the flowchart of FIG. 14, the fifth embodiment of the throttle valve control system according to the present invention will be explained hereinafter.

In this embodiment, the CPU 27 operates as first and second setting means, and a correction means, and the CPU 27 and the drive circuit 26a operate as the drive means.

Figure 14:
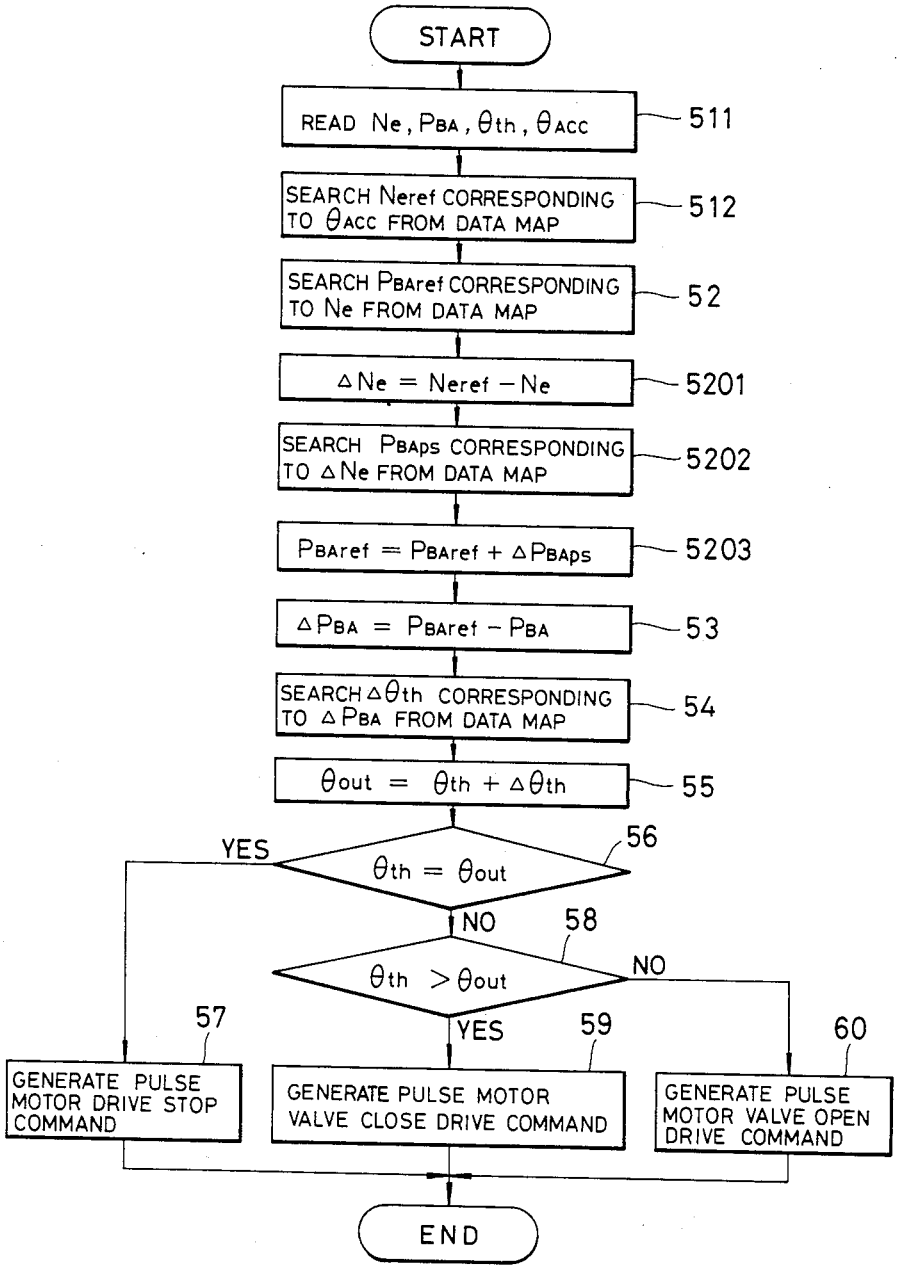
FIG. 14 is a diagram showing the operation of the CPU 27 in a fifth embodiment of the present invention.
Figure 15:
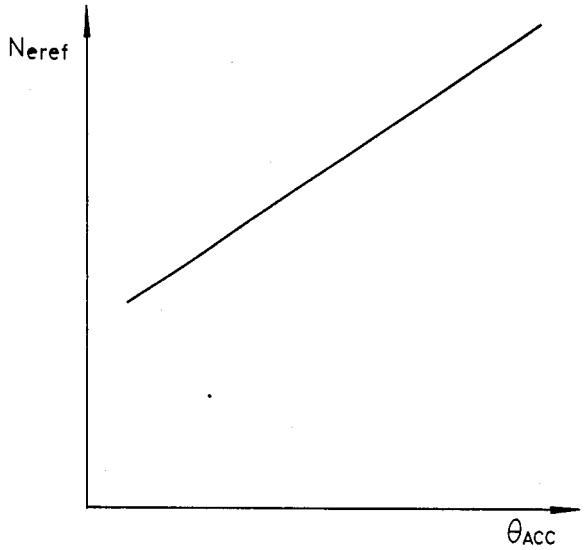
FIG. 15 is a diagram showing the characteristic of an Neref data map which is previously stored in the ROM 28 in the fifth embodiment of the present invention.
Figure 16:
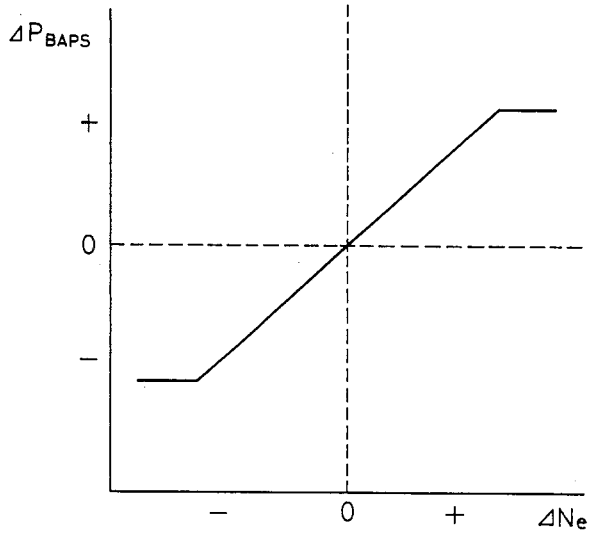
FIG. 16 is the characteristic of a $\Delta P_{BAps}$ data map previously stored in the ROM 28 in the fifth embodiment of the present invention.

In the flowchart of FIG. 14, the CPU 27 at first reads the engine rotational speed Ne, the absolute intake manifold pressure $P_{BA}$, the throttle valve opening $\theta$th, and the accelerator pedal angle $\theta_{ACC}$ at the predetermined intervals at the step 511. At a step 512, the CPU 27 searches a target engine rotation speed Neref corresponding to the read value of the accelerator pedal angle $\theta_{ACC}$ from a Neref data map which is previously stored in the ROM 28 and has a characteristic shown in FIG. 15. In addition, for the searching of the target engine rotational speed at the step 511 different data maps are used correspondingly to the shift position of the transmission system (not shown). Then, as in the previous embodiments, the CPU 27 searches the target absolute intake manifold pressure $P_{BAref}$ from the data map at the step 52. Subsequently, a change amount $\Delta$Ne between the target engine rotational speed Neref and the read value of the engine rotational speed Ne is calculated at a step 5201, and a correction amount $\Delta P_{BAps}$ of the target absolute intake manifold pressure corresponding to the change amount $\Delta$Ne is searched from a $\Delta P_{BAps}$ data map in the ROM 28 at a step 5202. In the ROM 28, the correction amount of the target absolute intake manifold pressure $P_{BAps}$ corresponding to the change amount of the engine rotational speed is previously stored in the form of the data map having the characteristic shown in FIG. 16. The target absolute intake manifold pressure $P_{BAref}$ searched out at the step 52 is then added to this correction amount $\Delta P_{BAps}$, and the value obtained by this calculation is made as a new value of the target absolute intake manifold pressure $P_{BAref}$ at a step 5203. Then the operation of the system proceeds to the steps 53 through 60 through which the throttle valve 12 is operated in the same manner as the first embodiment of the present invention. Therefore, the explanation of the operations through these steps will not be repeated.

In the above described fifth embodiment of the throttle valve control system according to the present invention, the target engine rotational speed is set in accordance with the operation position of the accelerator pedal, and the target intake manifold pressure at which the minimum fuel consumption rate is attained is corrected in response to the difference between the actual engine rotational speed and the target engine rotational speed. Therefore, if the accelerator pedal is depressed rapidly, the difference between the actual engine rotational speed and the target engine rotational speed increases, to correct the target intake manifold pressure correspondingly. Thus, the throttle valve opening can be increased immediately, so that the engine rotation speed is raised at once if the accelerator pedal is depressed rapidly. In this way, a desirable acceleration characteristic of the engine is assured.

Since the operations of the first through fifth embodiments of the present invention are performed by the same system structure as shown in FIGS. 1 and 2, the explanation of each component of the system was not repeated in the above description of respective embodiments of the present invention.

Furthermore, in the above explained embodiments of the present invention, the system is constructed such that the drive circuit 26a supplies pulses to the pulse motor 15 at a predetermined rate in accordance with the pulse motor valve open drive command or the pulse motor valve close drive command supplied from the CPU 27. However, it is also possible to adopt such an arrangement that the pulse motor valve open drive command or the pulse motor valve close drive command generated by the CPU 27 represents the number of pulses corresponding to the difference between the actual throttle valve opening $\theta$th and the control valve opening $\theta$out, and the drive circuit 26a supplies the drive pulses of the number determined by these commands from the CPU 27 to the pulse motor 15.

In addition, it is to be noted that the throttle valve control system according to the present invention is best suited for use with a device which determines the engine rotational speed in accordance with the operated position of the accelerator pedal such as a CVT (continuously variable transmission) system.

What is claimed is:

1. A throttle valve control system for controlling the opening of a throttle valve disposed in an air induction system of an internal combustion engine when said throttle valve is in a position other than its idle position, comprising:

engine speed detection means for detecting the rotational speed of said internal combustion engine;

pressure detection means for detecting the actual pressure in an intake pipe of said air induction system, downstream of said throttle valve;

setting means for setting a target pressure in the intake pipe to attain a minimum fuel consumption rate of said internal combustion engine in accordance with said rotational speed detected by said engine speed detection means; and drive means for driving said throttle valve in a direction and by an amount selected to reduce the actual pressure in said intake pipe when the actual pressure in the intake pipe detected by said pressure detection means is higher than said target pressure set by said target pressure setting means and to increase the actual pressure in said intake pipe when the actual pressure detected by said pressure detection means is lower than said target pressure set by said target pressure setting means.

2. A throttle valve control system as set forth in claim 1, wherein said drive means comprise correction amount determining means for determining an opening correction amount in accordance with the difference between the actual pressure in the intake pipe detected by said pressure detection means and said target pressure in the intake pipe set by said target pressure setting means, and means for driving said throttle valve so that its opening becomes equal to a control opening determined by using said opening correction amount.

3. A throttle valve control system as set forth in claim 1, wherein said drive means comprise correction amount determining means for determining an opening correction amount in accordance with the difference between the actual pressure in the intake pipe detected by said pressure detection means and said target pressure in the intake pipe set by said target pressure setting means, and with the rotational speed of the engine detected by said engine speed detection means, and means for driving said throttle valve so that its opening becomes equal to a control opening determined by using said opening correction amount.

4. A throttle valve control system for controlling the opening of a throttle valve disposed in an air induction system of an internal combustion engine mounted on a vehicle, comprising:

accelerator pedal operation position detection means for detecting an operation position of an accelerator pedal of said vehicle;

engine speed detection means for detecting a rotational speed of said internal combustion engine;

pressure detection means for detecting the actual pressure in an intake pipe of said air induction system, downstream of said throttle valve;

throttle valve opening detection means for detecting the actual opening of said throttle valve;

first setting means for setting a target pressure in the intake pipe to attain a minimum fuel consumption rate of said internal combustion engine in accordance with said rotational speed detected by said engine speed detection means;

second setting means for setting a target valve opening corresponding to said operation position of said accelerator pedal;

drive means for driving said throttle valve to an opening selected to reduce a difference between said actual pressure in the intake pipe detected by said pressure detection means and said target pressure in the intake pipe, wherein said drive means is adapted to drive said throttle valve only in accordance with said operation position of said accelerator pedal when said actual throttle opening detected by said throttle valve opening detection means is smaller than said target throttle valve opening while said operation position of said accelerator pedal detected by said accelerator pedal operation position detection means exceeds a predetermined position.

5. A throttle valve control system for controlling the opening of a throttle valve disposed in an air induction system of an internal combustion engine mounted on a vehicle, comprising:

accelerator pedal operation position detection means for detecting the operation position of an accelerator pedal of said vehicle and producing an accelerator pedal operation position signal;

change speed detection means for detecting the rate of change in said operation position of said accelerator pedal by means of said accelerator pedal operation position signal;

engine speed detection means for detecting a rotational speed of said internal combustion engine;

pressure detection means for detecting the actual pressure in an intake pipe of said air induction system, downstream of said throttle valve;

setting means for setting a target pressure in the intake pipe to attain a minimum fuel consumption rate of said internal combustion engine in accordance with said engine rotational speed detected by said engine speed detection means;

drive means for driving said throttle valve to a control opening selected to reduce a difference between said actual pressure in the intake pipe detected by said pressure detection means and said target pressure in the intake pipe set by said setting means, wherein said drive means is adapted to drive said throttle valve to an opening corresponding to said rate of change in the operation position of said accelerator pedal as said throttle valve control opening when said rate of change in the operation position of the accelerator pedal is higher than a predetermined value.

6. A throttle valve control system as set forth in claim 5, wherein said drive means is adapted to drive said throttle valve gradually to said opening when said speed of change in the accelerator pedal operation position has decreased to be smaller than said predetermined value from a value greater than said predetermined value.

7. A throttle valve control system for controlling the opening of a throttle valve disposed in an air induction system of an internal combustion engine mounted on a vehicle, comprising:

engine speed detection means for detecting a rotational speed of said internal combustion engine;

accelerator pedal operation position detection means for detecting an operation position of an accelerator pedal of said vehicle;

pressure detection means for detecting an actual pressure in an intake pipe of said air induction system, downstream of said throttle valve;

first setting means for setting a target engine rotational speed corresponding to said operation position of said accelerator pedal detected by said accelerator pedal operation position detection means;

second setting means for setting a target pressure in the intake pipe to attain a minimum fuel consumption rate of said internal combustion engine, in accordance with said rotational speed detected by said engine speed detection means;

correction means for correcting said target pressure in the intake pipe in accordance with a difference between said target engine rotational speed and said rotational speed detected by said engine speed detection means, and producing a corrected target pressure in the intake pipe; and drive means responsive to said actual pressure signal and said corrected target pressure in the intake pipe, for driving said throttle valve in a direction and by an amount selected to reduce a difference between said actual pressure in the intake pipe detected by said pressure detection means and said corrected target pressure in the intake pipe produced by said correction means.

* * * * *